US006412407B1

(12) United States Patent
Brocker et al.

(10) Patent No.: US 6,412,407 B1
(45) Date of Patent: Jul. 2, 2002

(54) SCREEN PRINTING INSTALLATION

(75) Inventors: Heinz Brocker, St. Gallen; Hansrudolf Frick, Thal, both of (CH)

(73) Assignee: Gallus Ferd Ruesch AG, St. Gallen (CH)

( * ) Notice: Subject to any disclaimer, the term of this patent is extended or adjusted under 35 U.S.C. 154(b) by 0 days.

(21) Appl. No.: 09/529,453

(22) PCT Filed: Aug. 26, 1998

(86) PCT No.: PCT/CH98/00368

§ 371 (c)(1),
(2), (4) Date: Apr. 13, 2000

(87) PCT Pub. No.: WO99/19146

PCT Pub. Date: Apr. 22, 1999

(30) Foreign Application Priority Data

Oct. 14, 1997 (CH) ..... 2393/97

(51) Int. Cl.[7] ..... B41F 15/46
(52) U.S. Cl. ..... 101/116; 101/120
(58) Field of Search ..... 101/116, 119, 101/120, 123, 124

(56) References Cited

U.S. PATENT DOCUMENTS 5,095,816 A * 3/1992 Hasegawa et al. ..... 101/119
5,323,700 A * 6/1994 Katsuyama et al. ..... 101/119
5,357,856 A * 10/1994 Hasegawa et al. ..... 101/119
5,375,516 A * 12/1994 Hasegawa ..... 101/119
5,419,243 A * 5/1995 Hanzawa et al. ..... 101/118
5,483,878 A * 1/1996 Hanzawa ..... 101/118
5,671,671 A * 9/1997 Wysmann et al. ..... 101/120
5,782,178 A * 7/1998 Otomo ..... 101/119

FOREIGN PATENT DOCUMENTS

| | | | |
|---|---|---|---|
| DE | 29 25 200 | | 1/1981 |
| EP | 0 555 073 A1 | | 8/1993 |
| EP | 0 723 864 A1 | | 7/1996 |
| FR | 2 156 960 | | 6/1973 |
| JP | 169154 | * | 6/1997 |

* cited by examiner

*Primary Examiner*—Stephen R. Funk
(74) *Attorney, Agent, or Firm*—Pearne & Gordon LLP

(57) ABSTRACT

A screen printing apparatus with a circular screen (1) and a squeegee (2) therein and an impression cylinder (3). A system that is synchronized with a screen drive device and the impression cylinder (3), and lifting the squeegee (2) in controlled manner. The system includes at least one cam disk (14) which, via a squeegee lever (16), moves the squeegee (2) into the desired position.

8 Claims, 4 Drawing Sheets

SCREEN PRINTING INSTALLATION

BACKGROUND OF THE INVENTION

The present invention relates to screen printing apparatus comprising a circular screen with a squeegee within it, further to an impression cylinder for the circular screen, drive means and a system for detaching the squeegee during printing.

Screen printing apparatus of this kind are known and their circular screens are designed for discontinuous web printing or for sheet-fed printing.

In such procedures, when in a discontinuous web printing mode, the gap between printing end and printing beginning of the next print is minimal (because of the expensive printing materials). Commensurately, when in the sheet-fed mode, the distance between the front paper edge to the beginning of print also is minimal.

As regards optimal solutions of such problems with printing speeds becoming ever higher, increasing difficulties are encountered to move the squeegee in very short cycles (10 ms). Due to the interaction of different inks and patterns having different demands for inks, the apparatus requires extraordinary dynamics not easily controlled. Also, as regards circular screens, the ink runs through the screen in the stationary mode (open sites; the pattern is situated over the full periphery).

SUMMARY OF THE INVENTION

The present invention is directed toward a screen printing apparatus that allows very high operational speeds at short times of displacement, namely using separate cam disks. Such mechanical controls and appropriate designs markedly reduce the squeegee's inertial forces.

Thanks to the cam disk, the squeegee pressure is generated mechanically. Mechanical generation of squeegee pressure substantially increases the speed, as compared to pneumatic controls.

The cam disk is preferably adjustable also in operation at its periphery with respect to the beginning of printing in order to attain the least spacing between printing end and beginning of printing. The effects of ink and of ink removal can be compensated by adjusting the cam disk. The adjustment or setting of the cam disk can be initiated, in the case of a central drive, by bevel gearing or by separate drives, for the circular screen and the squeegee (adjustment inside the synchronizing system).

The circular screen may comprise, in its null position, a closed zone to preclude ink leakage. Preferably, an ink-level regulator is used so that only minimal ink is needed in the screen.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
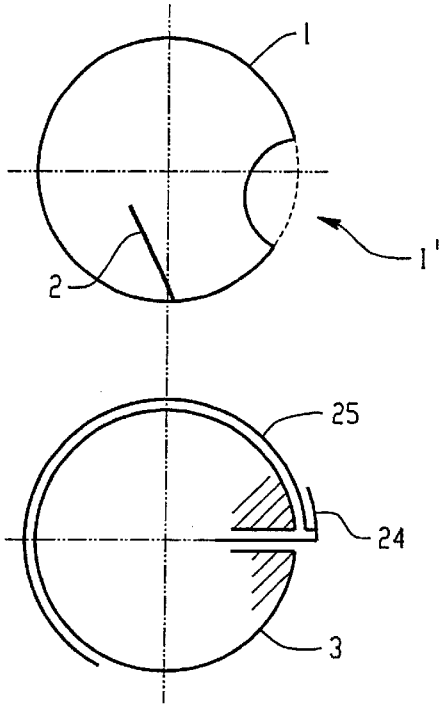
FIG. 1 diagrammatically illustrates a screen printing apparatus integrated on a sheet-fed press.
Figure 2:
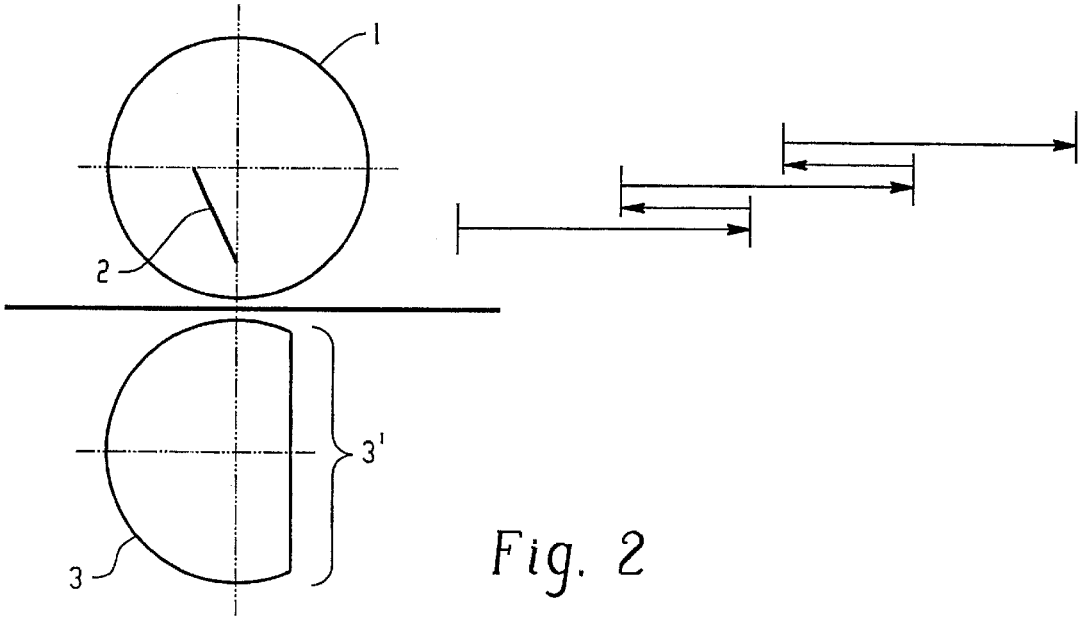
FIG. 2 is a view similar to FIG. 1, with a rotary screen printing apparatus on a web-fed press with a reciprocating web transport, FIG. 3 diagrammatically shows a rotary screen printing apparatus integrated on a substrate printing machine, with plane or cylindrical substrates.
Figure 3:
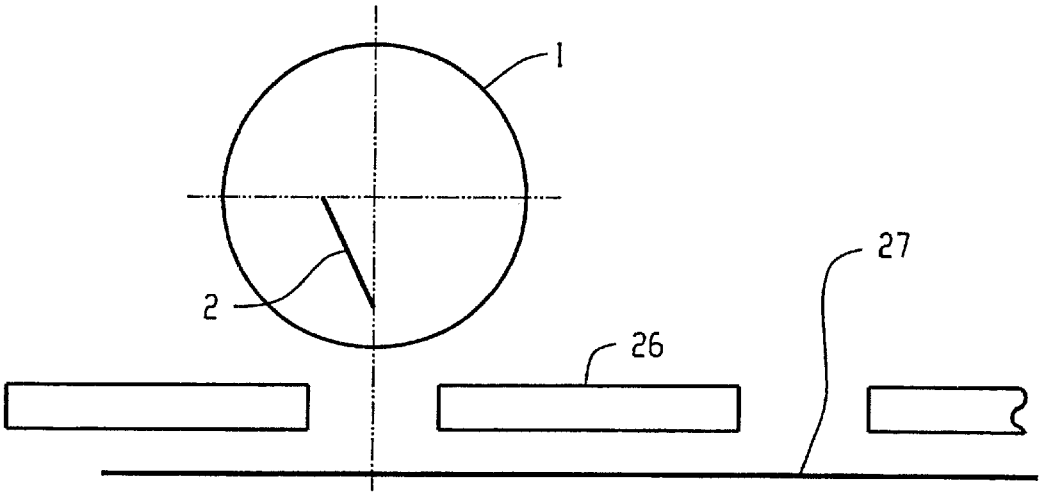
Figure 3:
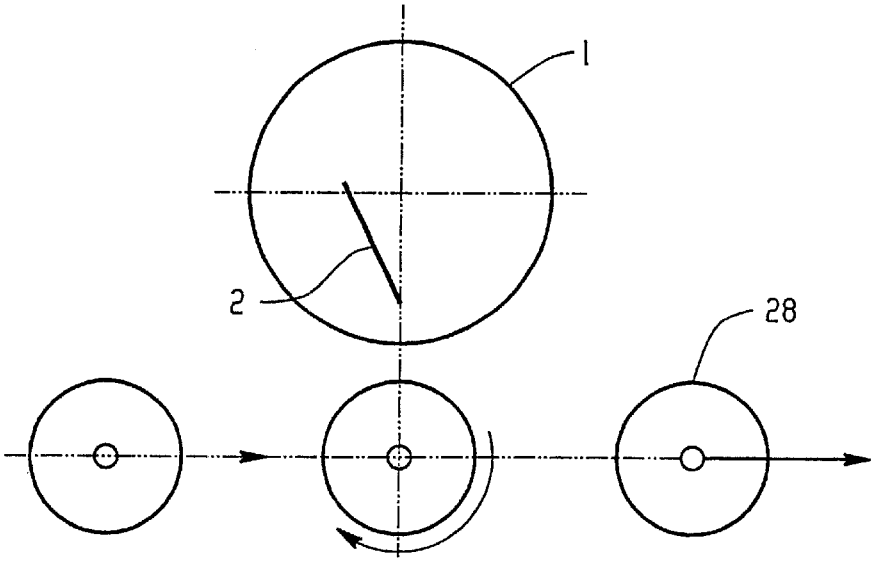

FIGS. 1 through 3 illustrate the principles of various rotary screen printing methods.

FIG. 1 shows a rotary screen printing apparatus integrated on a sheet-fed press. The circular screen 1 is fitted, optionally, with an indentation 1'. The squeegee 2 mounted inside the screen is linked to a device (not shown) for lifting the squeegee 2 in a controlled manner. A sheet 25 that can be gripped by a gripper 24 rests on the impression cylinder 3. When the gripper 24 projects from the pit of the impression cylinder, the circular screen 1 will be provided with an indentation 1' (for instance in the form of a cross-strip with an uncovered zone for the projecting gripper 24 at the impression cylinder 3). When the gripper 24 is countersunk (not shown), the circular screen does not need an indentation. However, in both cases the squeegee 2 must be lifted above the indentation 1' or the pit with countersunk gripper 24.

FIG. 2 diagrammatically shows a rotary screen printing apparatus integrated on a web-fed press with reciprocating web transport. An impression cylinder 3 with an uncovered zone 3' is present beside the circular screen 1 with squeegee 2 (with a linked device (not shown) to lift the squeegee in controlled manner). In this embodiment the squeegee 2 must be lifted each time above the uncovered zone 3' because of the web being drawn back (reciprocation).

FIG. 3 shows the principle of a rotary screen printing apparatus integrated on a substrate printing machine. In this design, the circular screen 1 is fitted with a squeegee 2 raised in controlled manner. The substrates (impression cylinders) to be printed may be planar bodies 26 (for instance glass plates) moved on a conveyor belt 27 or they may be cylindrical bodies 28 (for instance bottles).

The substrates 26 or 28 to be printed form the impression cylinders. The squeegee 2 must be raised when between the individual substrates.

Figure 4:
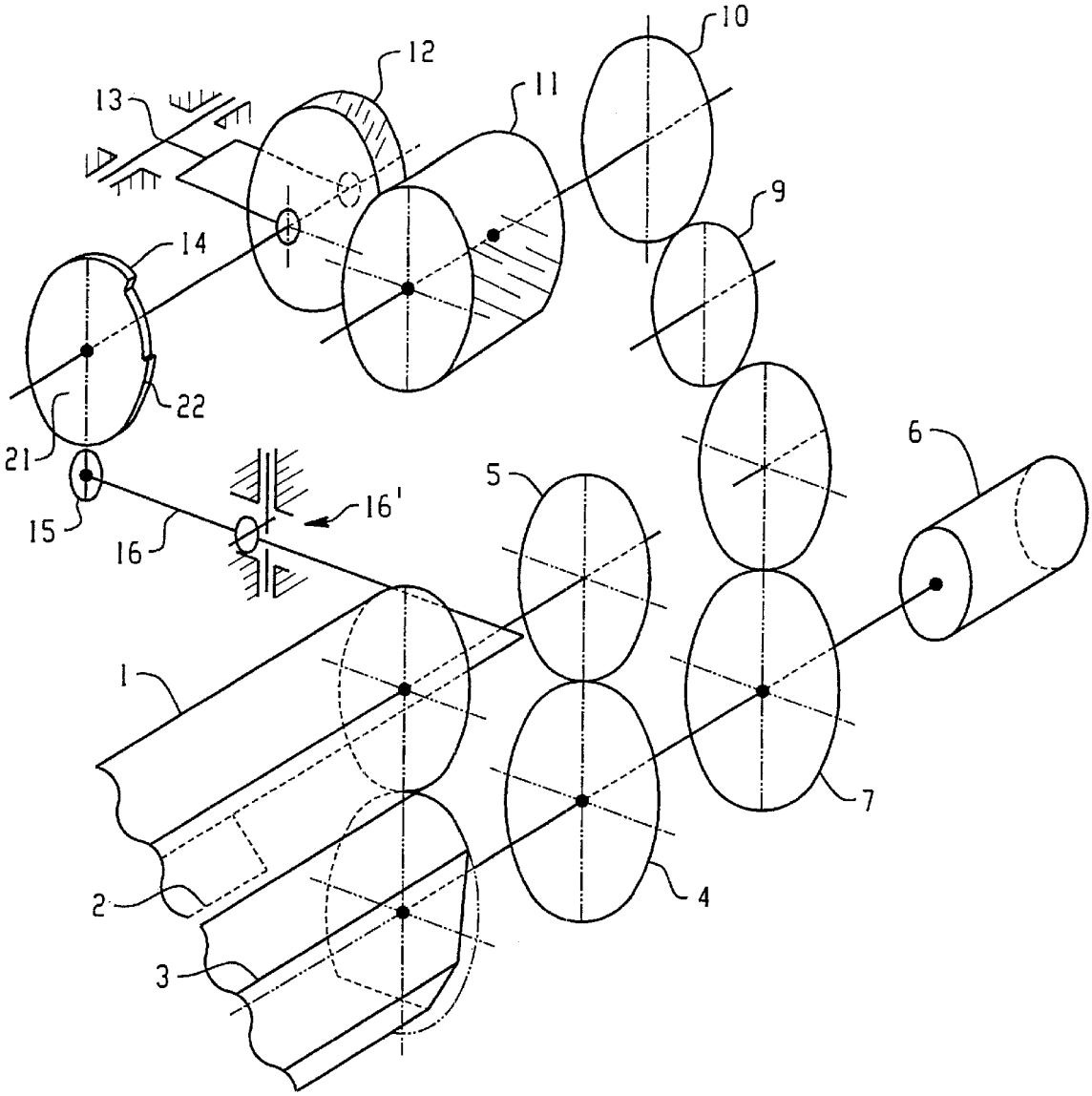
FIG. 4 is a diagrammatic sketch of a synchronized drive for a circular screen with controlled squeegee and the impression cylinder in a mechanical embodiment (one side of the machine), and FIG. 5 diagrammatically illustrates a rotary silk printing apparatus with discontinuous squeegee pressure (in the absence of impression pressure).

FIG. 4 shows a synchronized drive system for the circular screen 1, the squeegee 2 and the impression cylinder 3 (in this case an impression cylinder with an uncovered zone of a reciprocating machine) of a screen printing apparatus.

The synchronized drive system is situated on one side of the printing apparatus. However, a further cam disk with a lever controlling the squeegee 2 may be provided on the other side of the circular screen 1.

The synchronized drive system for the circular screen 1, squeegee 2 and impression cylinder 3 is substantially implemented by means of the following components: driven by a motor 6, the gears 4, 5 move the circular screen 1 and the impression cylinder 3.

The motor 6 in this design drives the printing apparatus. In principle, such a drive also may be delivered by the main machine shaft.

The gears 7 through 10 drive a bevel gear 11, which is part of the control system for the squeegee 2.

The cam disk 14 is driven by a further bevel gear 12, which is positioned in transversely displaceable manner by an adjusting mechanism 13. Due to bevel gear, this adjusting mechanism 13 allows highly accurately setting the phase of the cam disk 14 (also during operation).

The contour of the cam disk 14 may be fixed or variable, for instance by consisting of two mutually oppositely rotatable panes 21, 22.

The squeegee is controlled, i.e. lifted, by means of an idler roller 15 and the squeegee lever 16, which illustratively is a kind of rocking lever pivoted about the point 16'. Because of the support at point 16', the squeegee pressure can be made adjustable. In the case of two cam-disk panes, the squeegee 2 is held in place and is controlled more precisely and the compression is more easily regulated.

Besides the purely mechanical design of the drive system, a hybrid electro-mechanical design also may be used.

Figure 5:
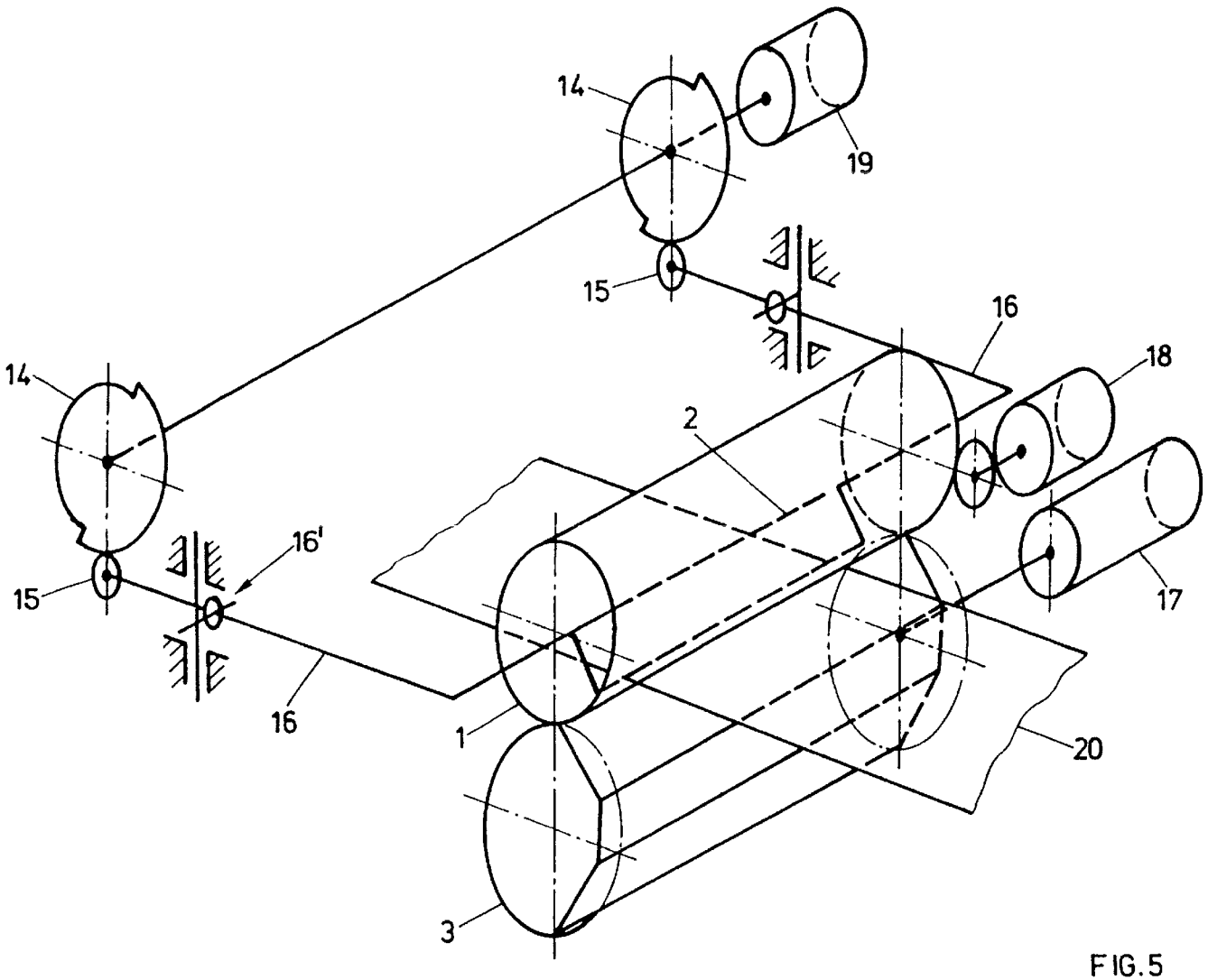

FIG. 5 is a design similar to that of FIG. 4, and shows a rotary screen printing system with discontinuous squeegee pressure. In this embodiment, the circular screen 1, the squeegee 2, or the control cam disks 14, and the impression cylinder 3 (shown as a reciprocating device) are driven by three mutually independent motors 17, 18, 19, as a result of which maximum adjustment flexibility is attained when in synchronization.

In this design the cam disks 14 may assume a fixed or a variable contour, as discussed above in relation to FIG. 4, and the squeegee pressure can be adjusted at the squeegee-lever's fulcrum 16'.

The squeegee pressure can be adjusted during operation (printing, see paper web 20).

The squeegee 2 always must be lifted in the absence of an opposing pressure, as otherwise the circular screen 1 might be damaged.

Due to the independent drives means, the circular screen may, for instance, be rotated into a position precluding the leakage of ink, however it may especially be driven in a suitable manner to insert the screen at an arbitrary, appropriate position.

What is claimed is:

1. A screen printing apparatus comprising a circular screen with a squeegee therein, an impression surface for the circular screen, drive means and a system to lift the squeegee in a controlled manner into a particular desired position during printing, wherein the squeegee control system comprises at least one cam disk to move the squeegee by means of at least one squeegee lever into the particular desired position, and said circular screen, said impression surface and said squeegee control system are operationally and synchronously connected to each other by a mechanical gear system, and adjustment of a phase of the cam disk is implemented by means of laterally displacing two mutually engaging bevel gears in the gear system which drive a shaft bearing the cam disk.

2. The screen printing apparatus as claimed in claim 1, wherein two identical cam disks mounted parallel to each other on a common shaft are provided for the squeegee and drive two squeegee levers which, in turn, enter from both sides the circular screen to engage the squeegee.

3. The screen printing apparatus as claimed in claim 1, further comprising means to adjust the squeegee compression during operation of the printing apparatus.

4. The screen printing apparatus as claimed in claim 1, wherein the circular screen, the impression surface and the squeegee control system are driven synchronously.

5. The screen printing apparatus as claimed in claim 4, wherein a single drive motor is used.

6. The screen printing apparatus as claimed in claim 4, wherein separate drive means are provided for the circular screen, the impression surface and the squeegee control system of the printing apparatus and are synchronized electrically or electronically.

7. The screen printing apparatus as claimed in claim 1, wherein a contour of the at least one cam disk is fixed.

8. The screen printing apparatus as claimed in claim 1, wherein a contour of the at least one cam disk is variable.

* * * * *

UNITED STATES PATENT AND TRADEMARK OFFICE

CERTIFICATE OF CORRECTION

PATENT NO. : 6,412,407 B1 
DATED : July 2, 2002
INVENTOR(S) : Heinz Brocker and Hansrudolf Frick It is certified that error appears in the above-identified patent and that said Letters Patent is hereby corrected as shown below:

Title page,
Item [75], please delete "St. Gallen", and insert therefor -- Herisau --.

Signed and Sealed this

Eighteenth Day of February, 2003

JAMES E. ROGAN
*Director of the United States Patent and Trademark Office*